US006676002B2

(12) United States Patent
Jairam et al.

(10) Patent No.: US 6,676,002 B2
(45) Date of Patent: Jan. 13, 2004

(54) PAPER GUIDE FOR STAPLER

(75) Inventors: Anthony Jairam, Sunrise, FL (US); Bikram Sohi, Wheeling, IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 10/079,307

(22) Filed: Feb. 20, 2002

(65) Prior Publication Data

US 2003/0155401 A1 Aug. 21, 2003

(51) Int. Cl.[7] ..... B25C 5/11

(52) U.S. Cl. ..... 227/154; 227/151; 227/155; 227/7

(58) Field of Search ..... 227/110, 120, 227/126, 127, 128, 132, 150, 151, 154, 155

(56) References Cited

U.S. PATENT DOCUMENTS

| | | | | | |
|---|---|---|---|---|---|
| 2,073,958 | A | * | 3/1937 | Crosby | 227/120 |
| 2,347,568 | A | * | 4/1944 | Kunert | 227/128 |
| 2,380,746 | A | * | 7/1945 | Gage | 227/151 |
| 2,897,500 | A | | 8/1959 | Lang | |
| D214,347 | S | * | 6/1969 | Power et al. | D8/49 |
| 3,523,634 | A | | 8/1970 | Power et al. | |
| D264,925 | S | * | 6/1982 | Bass et al. | D8/50 |
| D319,563 | S | | 9/1991 | Rosenblad | |
| D355,822 | S | * | 2/1995 | Smith | D8/50 |
| 5,692,667 | A | | 12/1997 | Chi | |
| D447,396 | S | | 9/2001 | Arns | |
| 2002/0027318 | A1 | | 3/2002 | Nilsson | |

OTHER PUBLICATIONS

Prior art Swingline Model 900XD, photo numbers 1496, 1499, and 1500.

Prior art Swingline 39 Heavy Duty Stapler, photo numbers 1501 and 1504.

Prior art Bostitch Model B300HDS, photo numbers 1505, 1508, and 1510.

Prior art Bostitch Model B310HDS, photo numbers 1511 and 1514.

Prior art Swingline 390, photo numbers 1515, 1518, and 1519.

Prior art Bostitch Model 00540, photo numbers 1520, 1523, and 1524.

Prior art Bostitch Model 136, Stock No. 73136, photo numbers 1525, 1528, and 1529.

Prior art Swingline 413, photo numbers 1536, 1539, and 1540.

* cited by examiner

*Primary Examiner*—Scott A. Smith
*Assistant Examiner*—Nathaniel Chukwurah
(74) *Attorney, Agent, or Firm*—Michael Best & Friedrich LLP

(57) ABSTRACT

A stapler includes a base having a top surface, a bottom surface, and an anvil. The stapler further includes a paper guide coupled to the base and movable relative to the anvil between a first substantially locked and immovable position and a second substantially locked and immovable position, without requiring access to the bottom surface of the base. The paper guide includes a body portion supported on the top surface of the base, and a locking member coupled to the body portion and operable to substantially lock and unlock the body portion. The locking member is preferably a lever movable relative to the body portion and having a projection engageable with a ramped surface on one of the body portion or the base to lock the paper guide relative to the base.

15 Claims, 2 Drawing Sheets

PAPER GUIDE FOR STAPLER

FIELD OF THE INVENTION

The invention relates to staplers, and more particularly to paper guides on staplers for aligning and locating papers to be stapled.

BACKGROUND OF THE INVENTION

Heavy duty staplers typically include a base that supports an anvil. The anvil is configured to receive and clinch the ends of the arms of a staple passing through the sheets being stapled. A paper guide is typically coupled to the base to help align multiple sheets being stapled and to locate and position the sheets with respect to the anvil so that the staple is properly located relative to the sheets.

Prior art paper guides are typically movable relative to the anvil to facilitate different stapling jobs. Typically, the paper guide is coupled to the base for sliding movement with respect to the anvil along the base. One common prior art paper guide mechanism includes a rod extending through a slot in the base. A coil spring surrounds the rod and is retained on the rod at one end by a stop washer and at the other end by the underside of the base. The spring is compressed between the stop washer and the base such that the paper guide is biased into frictional engagement with the base, thereby tending to keep the paper guide from sliding freely with respect to the anvil, but allowing the paper guide to be moved manually if sufficient force is applied to overcome the friction. Corresponding detents and projections formed on the paper guide and along the base provide a variety of different "set-points" that can be used for the paper guide.

Other prior art paper guide mechanisms are more difficult to adjust. With these paper guides, the rod extending through a slot in the base is threaded, and a fastener such as a wingnut or a hex-nut is provided under the base to more positively lock the paper guide into place relative to the anvil. Typically, the nut is tightened against the underside of the base such that the paper guide cannot slide at all. To adjust the position of the paper guide, the stapler must be turned over and the nut must be loosened. With the nut loose, the paper guide and rod are free to slide in the slot to the new desired position. The nut is then tightened to lock the paper guide into its new position.

Yet another type of prior art paper guide mechanism replaces the rod configurations described above with a projection having a lateral aperture. The aperture receives a metal strip (i.e., a metal leaf spring) configured to bias against and frictionally engage the underside of the base on either side of the slot. The strip functions much like the spring described above to keep the paper guide from sliding freely with respect to the anvil, but allowing the paper guide to be moved manually if sufficient force is applied to overcome the friction.

SUMMARY OF THE INVENTION

The prior art paper guide mechanisms present various problems. The manually-slidable guides often get moved unintentionally when a stack of papers is inserted into the stapler for stapling. The friction force created by the spring or the metal strip is simply not large enough to prevent unintended movement of the guide. As the stapler gets older, the spring force of the spring or strip may also decrease, making unintentional movement of the guide even more problematic.

While the prior art guides having nuts or similar fasteners on the underside of the base will create more positive locking to substantially prevent unintentional movement of the guide, they are difficult and burdensome to adjust. The user must turn the stapler over, grasp the nut, loosen the nut either manually or with a tool, slide the paper guide to the new desired position, and finally tighten the nut without moving the paper guide from the desired position. This operation must be completed while holding and orienting the stapler with both hands.

The present invention overcomes these and other problems and provides an improved paper guide for a stapler. The paper guide of the invention can be quickly and easily adjusted between substantially locked positions without accessing the underside of the stapler. Furthermore, unintentional movement of the paper guide during stapling operations is substantially eliminated.

More specifically, the invention provides a stapler including a base having a top surface, a bottom surface, and an anvil. The stapler further includes a paper guide coupled to the base and movable relative to the anvil between a first substantially locked and immovable position and a second substantially locked and immovable position, without requiring access to the bottom surface of the base.

In one aspect of the invention, the paper guide includes a body portion supported on the top surface of the base. The body portion includes a paper guide portion. A locking member is coupled to the body portion and operable to substantially lock and unlock the body portion for movement relative to the anvil, without requiring access to the bottom surface of the base. The locking member is preferably at least partially sandwiched between the body portion and the base and includes a projection. At least one of the top surface and the body portion includes a ramped surface such that the locking member is movable between a locked position, where the projection is engaged with the ramped surface, and an unlocked position, where the projection is not engaged with the ramped surface.

In another aspect of the invention, the base further defines a longitudinal axis and includes a slot extending between the top and bottom surfaces in the direction of the longitudinal axis. The paper guide further includes a pin coupled to the body portion and extending through the slot to guide the movement of the body portion in the direction of the longitudinal axis. The locking member is preferably a lever coupled to the body portion and pivotable about the pin.

The invention also provides a method of adjusting a paper guide on a stapler. The stapler includes a base having a bottom surface, and the paper guide includes a body portion and a locking member movable relative to the body portion. The method includes moving the locking member relative to the body portion to an unlocked position without accessing the bottom surface, moving the body portion relative to the base, and moving the locking member relative to the body portion to a locked position.

Other features and advantages of the invention will become apparent to those skilled in the art upon review of the following detailed description, claims, and drawings.

Figure 1:
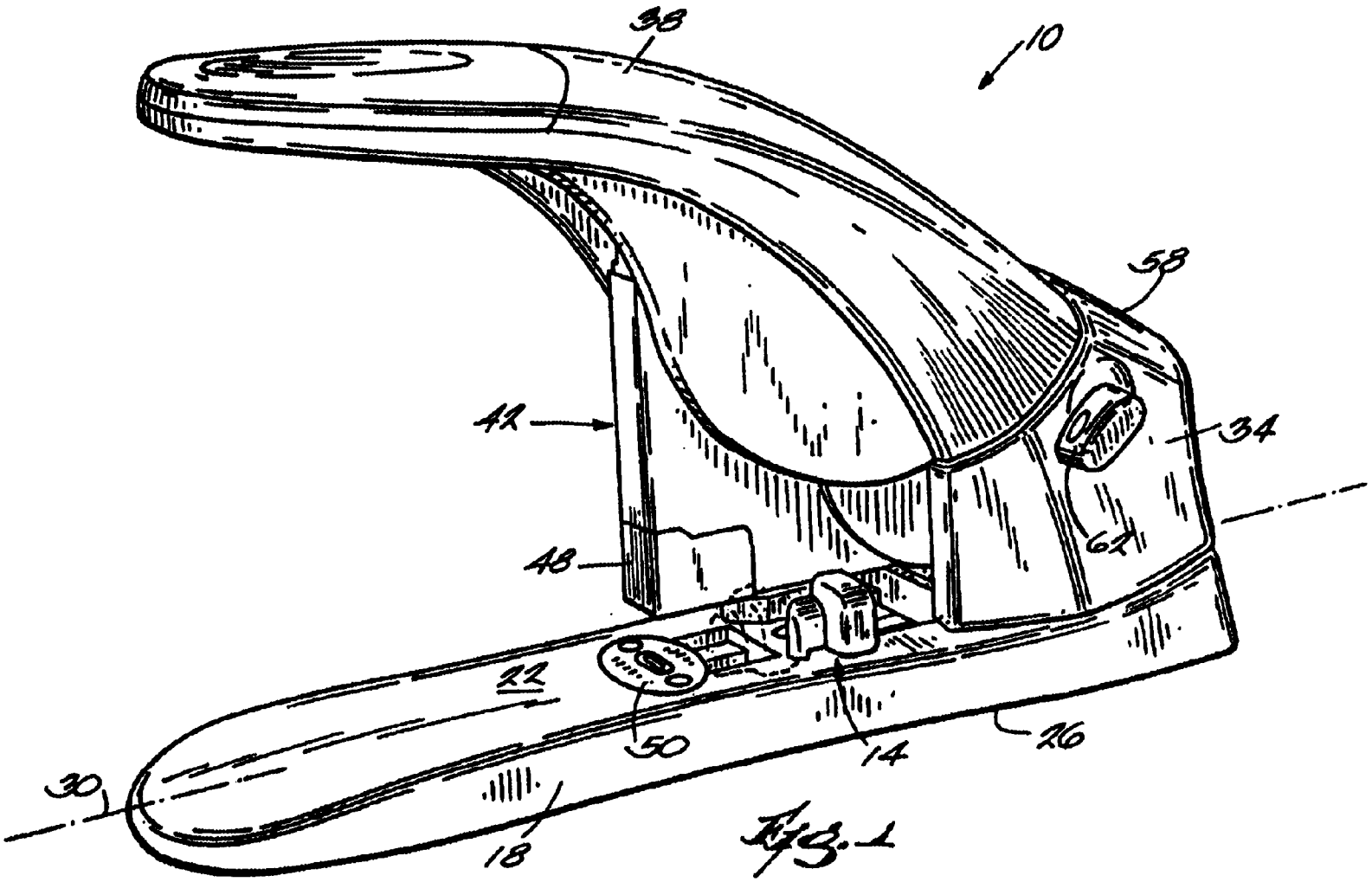
FIG. 1 is a perspective view of a stapler having a paper guide embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a stapler 10 including a paper guide 14 embodying the invention. The stapler 10 includes a base 18 having a top surface 22 and a bottom surface 26. The top surface 22 is configured to support a stack of sheets to be stapled. The bottom surface 26 is configured to support the stapler 10 on a support surface. The base 18 defines a longitudinal axis 30.

Figure 2:
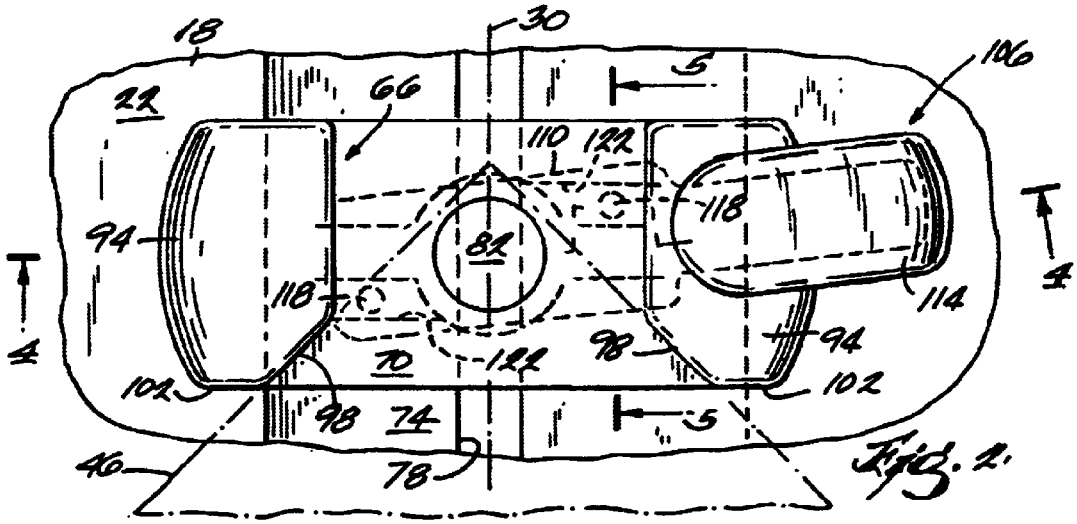
FIG. 2 is an enlarged top view of the paper guide shown in the unlocked position.
Figure 3:
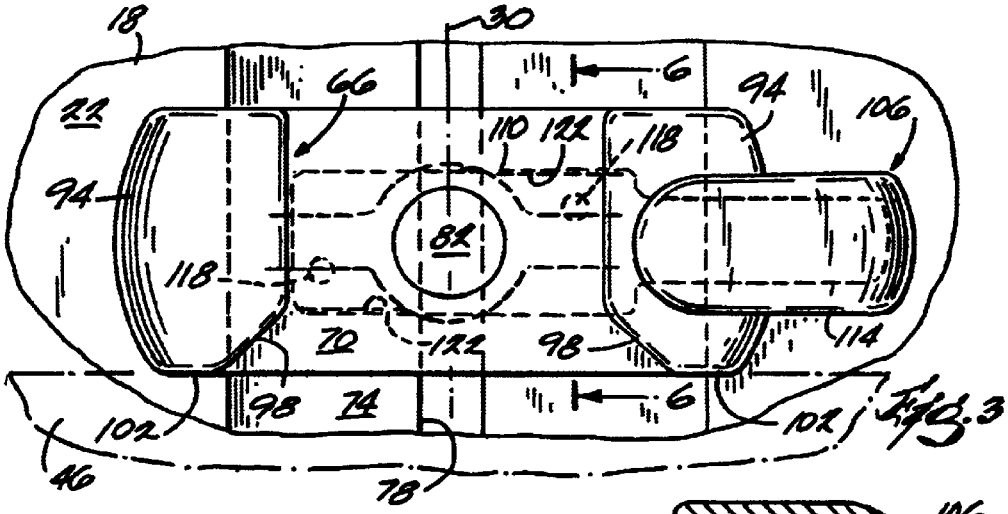
FIG. 3 is an enlarged top view of the paper guide shown in the locked position.

The base 18 includes an upper housing 34 that houses components of the stapling mechanism (not shown). A lever arm 38 is movably coupled (e.g., pivotally) to the base 18. A cartridge assembly 42 is also coupled with the upper housing 34 and the lever arm 38, and operates to discharge a staple into a plurality of sheets 46 (shown in phantom in FIGS. 2 and 3) upon manual actuation of the lever arm 38. The cartridge assembly 42 includes a magazine 48 that holds a row of staples. The magazine 48 includes a discharge opening (not shown) through which a staple is discharged from the magazine 48 into the sheets 46.

An anvil 50 is coupled to the top surface 22 of the base 18 and is configured to receive the legs of a staple (not shown) dispensed from the magazine 48. When the legs of the staple engage the anvil 50, they are bent and crimped, thereby fastening the sheets 46 in a manner understood by those skilled in the art.

The magazine 48 can be opened via a magazine release button 58 located on the upper housing 34. When the magazine release button 58 is depressed, the magazine 48 slides relative to the remainder of the cartridge assembly 42 in the direction of the longitudinal axis 30 and away from the upper housing 34. In the open position, the magazine 48 can be refilled with staples. To close the magazine 48, the user pushes the magazine 48 toward the upper housing 34.

The stapler 10 further includes a jam clearing mechanism operated by a jam clearing lever 62. In the illustrated embodiment, the jam clearing lever 62 is rotatable with respect to the upper housing 34. When the magazine 48 is jammed with a staple, the user manually rotates the jam clearing lever 62 one or more times until the jammed staple is cleared.

As best seen in FIG. 1, the paper guide 14 is coupled to the base 18 and is movable with respect to the anvil 50 and the discharge opening between a first substantially locked and immovable position (shown in solid lines in FIG. 1) and a second substantially locked and immovable position (shown in phantom in FIG. 1). As used herein and in the appended claims, the phrase "substantially locked and immovable position" means that the paper guide 14 is prevented from moving with respect to the base 18 so that the insertion of the plurality of sheets 46 between the magazine 48 and the base 18 cannot and will not, via direct engagement of the sheets 46 with the paper guide 14, cause the paper guide 14 to be unintentionally moved. Rather, in order to allow the paper guide 14 any movement with respect to the base 18, the user must first take some positive action to unlock the paper guide 14 before the paper guide 14 can be moved relative to the base 18.

Unlike prior art paper guides, the paper guide 14 can be moved between the first and second substantially locked and immovable positions without requiring access to the bottom surface 26 of the base 18. In other words, the paper guide 14 of the present invention provides for positive locking (unlike the prior art friction slide paper guides) without requiring the user to access the underside of the stapler 10 (unlike the prior art nut-lock paper guides).

Referring to FIGS. 2–6, the paper guide 14 includes a body portion 66 movably supported on the top surface 22 of the base 18. In the illustrated embodiment, the body portion 66 includes a slide frame portion 70 slidably received in an elongated recess 74 formed in the top surface 22 of the base 18. The elongated recess 74 preferably extends between the anvil 50 and the upper housing 34 in the direction of the longitudinal axis 30. An elongated slot 78 also extends in the direction of the longitudinal axis 30 and communicates between the elongated recess 74 and the bottom surface 26 of the base 18. It should be understood that while the elongated recess 74 and the elongated slot 78 facilitate the use and operation of the paper guide 14, the elongated recess 74 and/or the elongated slot 78 could be eliminated without deviating from the invention.

Figure 4:
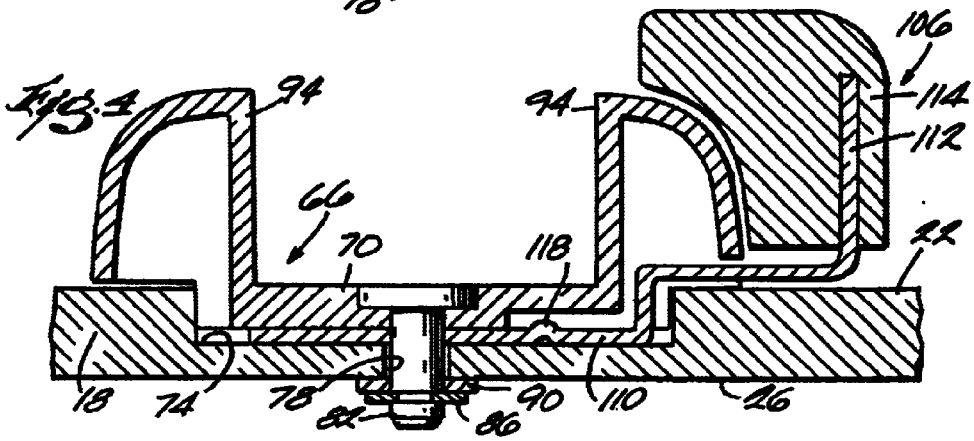
FIG. 4 is a section view taken along line 4—4 of FIG. 2.

As best seen in FIG. 4, the slide frame portion 70 is coupled with the base 18 via a pin 82 passing through the slide frame portion 70 and the elongated slot 78. A snap ring 86 is fastened on the pin 82 adjacent the bottom surface 26, thereby securing the body portion 66 in the elongated recess 74 and guiding the movement of the body portion 66 along the length of the elongated slot 78. A washer 90 is sandwiched between the snap ring 86 and the bottom surface 26.

The body portion 66 further includes a paper guide portion. In the illustrated embodiment, the paper guide portion includes opposing paper guide projections 94 extending from the slide frame portion 70. The paper guide projections 94 each include an angled surface 98 configured to receive and align the plurality of sheets 46 in the manner illustrated in FIG. 2. Additionally, the paper guide projections 94 also include paper receiving surfaces 102 that are substantially perpendicular to the longitudinal axis 30 to receive and align the plurality of sheets 46 in the manner illustrated in FIG. 3.

The paper guide 14 also includes a locking member 106 coupled to the body portion 66 and operable to substantially lock and unlock the body portion 66 for movement relative to the base 18 and the anvil 50. The locking member 106 is configured to allow a user to lock and unlock the body portion 66 from the top surface 22 of the base, without requiring access to the bottom surface 26. In other words, the user will not be required to turn over the stapler 10 in order to move the paper guide 14.

Figure 6:
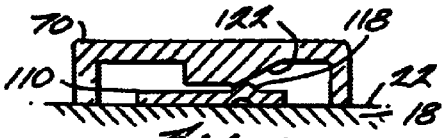
FIG. 6 is a section view taken along line 6—6 of FIG. 3.
Figure 5:
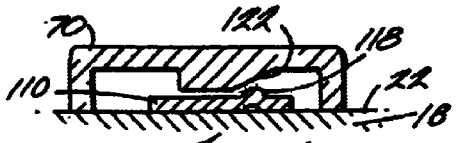
FIG. 5 is a section view taken along line 5—5 of FIG. 2.

In the illustrated embodiment, the locking member 106 includes a lever 110 sandwiched between the top surface 22 of the base 18 and the slide frame portion 70, as best shown in FIGS. 4–6. The lever 110 pivots about the pin 82, relative to the body portion 66. An arm 112 (see FIG. 4) of the lever 110 extends out of the elongated recess 74. A gripping portion 114 is coupled to the arm 112 adjacent the paper guide portion to allow the user to readily pivot the lever 110 between the unlocked position (see FIG. 2) and the locked position (see FIG. 3).

The lever 110 includes diametrically opposed projections 118 configured to engage respective ramped surfaces 122 formed on the underside of the slide frame portion 70. When the lever 110 is pivoted to the unlocked position (see FIGS. 2 and 5), the projections 118 are not engaged with the ramped surfaces 122, and the body portion 66 is free to move longitudinally with respect to the base 18 for adjustment. In the unlocked position, the stack height of the slide frame portion 70, the lever 110, the base 18, and the washer 90 remains less than the effective length of the pin 82 between the pin head and the snap ring 86, thereby allowing relative movement between the base 18 and the body portion 66.

When the lever 110 is pivoted to the locked position (see FIGS. 3 and 6), the projections 118 are tightly engaged with the ramped surfaces 122. The frictional and wedge-like engagement between the projections 118 and the ramped surfaces 122 biases the body portion 66 away from the base 18 to the extent permitted by the effective length of the pin 82 up to the snap ring 86. In the locked position, the stack height of the slide frame portion 70, the lever 110, the base 18, and the washer 90 equals the effective length of the pin 82 between the pin head and the snap ring 86. The washer 90 bears against the bottom surface 26 in tight frictional engagement, thereby substantially and immovably locking the body portion 66 with respect to the base 18 to prevent relative movement between the base 18 and the paper guide 14. When the paper guide 14 is in the locked position, the user can staple the plurality of sheets 46 without fear that the paper guide 14 may unintentionally move as the sheets 46 are being inserted or stapled.

Those skilled in the art will recognize various alternatives to the specific locking arrangement illustrated and described above. For example, the projections 118 could extend toward the base 18 to engage ramped surfaces formed on the base 18. Additionally, other known geometric configurations and types of engagements can be substituted for the specific projection and ramp configurations shown. Furthermore, the locking member 106 need not be pivotable with respect to the body portion 66 as illustrated, but rather could be rotatable or linearly movable between the locked and unlocked positions.

Various features of the invention are set forth in the following claims.

What is claimed is:

1. A stapler comprising:

a base having a top surface, a bottom surface, and an anvil; and a paper guide coupled to the base and movable relative to the anvil between a first substantially locked and immovable position and a second substantially locked and immovable position without requiring access to the bottom surface of the base, the paper guide including a body portion supported on the top surface of the base, the body portion including a paper guide portion; and a locking member coupled to the body portion and operable to substantially lock and unlock the body portion for movement relative to the anvil without requiring access to the bottom surface of the base;

wherein the locking member includes a projection, wherein at least one of the top surface and the body portion includes a ramped surface, and wherein the locking member is movable between a locked position, where the projection is engaged with the ramped surface, and an unlocked position, where the projection is not engaged with the ramped surface.

2. The stapler of claim 1, wherein the locking member is at least partially sandwiched between the body portion and the base.

3. The stapler of claim 1, wherein the base further defines a longitudinal axis and includes a slot extending between the top and bottom surfaces in the direction of the longitudinal axis, and wherein the paper guide further includes a pin coupled to the body portion and extending through the slot to guide the movement of the body portion in the direction of the longitudinal axis.

4. The stapler of claim 3, wherein the locking member is a lever coupled to the body portion and pivotable about the pin.

5. The stapler of claim 1, wherein the locking member includes a gripping portion adjacent the paper guide portion.

6. The stapler of claim 1, further comprising:

a recess in the top surface, at least a portion of the paper guide being slidably received in the recess.

7. A stapler comprising:

a base having a top surface; and a paper guide coupled to the base and movable relative to the base, the paper guide including a body portion; and a locking member coupled to the body portion between the body portion and the top surface of the base and being movable with respect to the body portion between a locked position, where the body portion is substantially locked and immovable with respect to the base, and an unlocked position, where the body portion is movable with respect to the base.

8. The stapler of claim 7, wherein the base further defines a longitudinal axis and includes a slot extending through the base in the direction of the longitudinal axis, and wherein the paper guide further includes a pin coupled to the body portion and extending through the slot to guide the movement of the body portion in the direction of the longitudinal axis.

9. The stapler of claim 8, wherein the locking member is a lever coupled to the body portion and pivotable about the pin.

10. The stapler of claim 7, wherein the locking member includes a projection, wherein at least one of the base and the body portion includes a ramped surface, and wherein the projection is engaged with the ramped surface when the locking member is in the locked position, and the projection is not engaged with the ramped surface when the locking member is in the unlocked position.

11. The stapler of claim 7, wherein the locking member includes a gripping portion adjacent the body portion.

12. The stapler of claim 7, further comprising:

a recess in the base, at least a portion of the body portion being slidably received in the recess.

13. A method of adjusting a paper guide on a stapler, the stapler including a base having a top surface and a bottom surface, and the paper guide including a body portion and a locking member movable relative to the body portion, the method comprising:

moving the locking member relative to the body portion to an unlocked position without accessing the bottom surface;

moving the body portion relative to the base; and moving the locking member relative to the body portion to a locked position;

wherein the locking member includes a projection, wherein at least one of the top surface of the base and the body portion includes a ramped surface, and wherein moving the locking member to the locked position includes engaging the projection with the ramped surface.

14. The method of claim 13, wherein moving the locking member to either of the locked and unlocked positions includes pivoting the locking member relative to the body portion.

15. The method of claim 13, wherein moving the locking member to the unlocked position includes disengaging the projection and the ramped surface.

* * * * *